US008814021B2

(12) United States Patent
Jones

(10) Patent No.: US 8,814,021 B2
(45) Date of Patent: Aug. 26, 2014

(54) APPARATUS AND METHOD FOR STRIPPING A PROTECTIVE COVERING FROM A DRINKING STRAW

(76) Inventor: Aaron W. Jones, Statesville, NC (US)

( * ) Notice: Subject to any disclaimer, the term of this patent is extended or adjusted under 35 U.S.C. 154(b) by 213 days.

(21) Appl. No.: 13/346,788

(22) Filed: Jan. 10, 2012

(65) Prior Publication Data

US 2013/0175283 A1 Jul. 11, 2013

(51) Int. Cl.
*B65B 61/00* (2006.01)

(52) U.S. Cl.
USPC ..... 225/1; 225/52; 221/63

(58) Field of Classification Search
CPC ..... A47G 21/00; H02G 1/1258; B26D 3/282
USPC ..... 225/1, 52, 85, 63, 24; 239/21; 81/9.4–9.44; 83/946, 953, 76.8, 145, 83/167; 30/90.6, 90.8; 220/695; 221/32, 221/63
See application file for complete search history.

(56) References Cited

U.S. PATENT DOCUMENTS 3,868,052 A * 2/1975 Rockefeller ..... 225/106
4,017,002 A * 4/1977 Doyle et al. ..... 221/63
4,631,059 A * 12/1986 Wolvek et al. ..... 604/528
5,992,286 A * 11/1999 Boole ..... 83/856
6,151,779 A * 11/2000 Brown ..... 30/2
6,754,960 B1 * 6/2004 Shiraishi et al. ..... 30/90.6
6,899,250 B2 * 5/2005 FitzSimons et al. ..... 221/45
7,398,599 B2 * 7/2008 Shiraishi et al. ..... 30/90.1
7,793,810 B2 * 9/2010 DeVries ..... 225/1
2006/0048619 A1 * 3/2006 Kelly et al. ..... 83/651
2006/0278045 A1 * 12/2006 Eastwood et al. ..... 81/9.4
2008/0256804 A1 * 10/2008 DeVries ..... 30/90.8
2011/0271807 A1 * 11/2011 Bottcher ..... 83/22
2012/0247493 A1 * 10/2012 Jones ..... 131/328

* cited by examiner

*Primary Examiner* — Boyer D Ashley
*Assistant Examiner* — Fernando Ayala
(74) *Attorney, Agent, or Firm* — Shumaker, Loop & Kendrick, LLP

(57) ABSTRACT

An apparatus for removing a portion of a protective covering from a drinking straw, including a support mounted on a container for receiving the portion of the protective covering removed from the drinking straw, and an orifice in the support having a shape and size adapted for receiving a drinking straw packaged in a protective covering through the orifice to the extent corresponding to the length of the portion of the covering to be removed from the drinking straw, the orifice positioned in the support to allow the protective covering to be received through the orifice but not withdrawn from the orifice. A related method is also disclosed.

4 Claims, 5 Drawing Sheets

APPARATUS AND METHOD FOR STRIPPING A PROTECTIVE COVERING FROM A DRINKING STRAW

TECHNICAL FIELD AND BACKGROUND OF THE INVENTION

This invention relates to an apparatus and method for stripping a protective covering, for example, a paper sleeve, from a drinking straw. Soda straws provided to patrons in restaurants are typically packaged for sanitary reasons in a protective paper sleeve that is removed when the straw is to be used. It has become customary in some restaurant environments for the restaurant staff to serve drinks with the straw already in the beverage, instead of furnishing the packaged straw with the drink and relying on the patron to remove the protective sleeve. Aside from providing a service to the patron, removing the sleeve before providing the straw to the patron reduces litter caused by the removed sleeve. However, sanitary considerations also indicate that the top of the sleeve covering the part of the straw to be placed in the mouth not be uncovered as an indication to the patron that the sleeve has just been removed and that the top of the straw is sanitary.

Removing only the bottom of the sleeve while leaving the top 2-3 inches of the sleeve as a "cap" on the straw requires that the straw be firmly grasped and the bottom portion of the sleeve be pulled and twisted at the same time to tear it away from the top portion, while holding the top portion of the sleeve to keep it on the top of the straw. Occasionally this process fails, and the straw is discarded. Moreover, carrying out this process repeatedly at frequent intervals does require a significant amount of time in the aggregate.

SUMMARY OF THE INVENTION

Therefore, it is an object of the invention to provide a method of quickly, efficiently and sanitarily removing a protective covering from a drinking straw.

It is a further object of the invention to provide an apparatus for quickly, efficiently and sanitarily removing a protective covering from a drinking straw.

These and other objects and advantages of the invention are achieved as described and claimed in this application by providing an apparatus for removing a portion of a protective covering from a drinking straw, including a support mounted on a container for receiving the portion of the protective covering removed from the drinking straw, and an orifice in the support having a shape and size adapted for receiving a drinking straw packaged in a protective covering through the orifice to the extent corresponding to the length of the portion of the covering to be removed from the drinking straw, the orifice positioned in the support to allow the protective covering to be received through the orifice but not withdrawn from the orifice.

According to one embodiment of the invention, the orifice includes a plurality of flexible blades defining the perimeter of the orifice and positioned to allow the protective covering to be received through the orifice but not withdrawn from the orifice.

According to another embodiment of the invention, a container is mounted under the support for receiving the portions of the protective covering removed from the drinking straw.

According to another embodiment of the invention, the support includes a tapered opening in the support for guiding the straw into the support.

According to another embodiment of the invention an apparatus is provided for removing a portion of a protective covering from a drinking straw, including a support mounted on a container for receiving the portion of the protective covering removed from the drinking straw; and a tapered opening in the support for guiding the straw into the support, and an orifice defining the bottom of the support and having a shape and size adapted for receiving a drinking straw packaged in a protective covering through the orifice to the extent corresponding to the length of the portion of the covering to be removed from the drinking straw, the orifice including a flexible blade defining the perimeter of the orifice positioned to allow the protective covering to be received through the orifice but not withdrawn from the orifice.

According to another embodiment of the invention a method of removing a portion of a protective covering from a drinking straw is provided, and includes the steps of providing a support mounted on a container for receiving the portion of the protective covering removed from the drinking straw, and an orifice in the support having a shape and size adapted for receiving a drinking straw packaged in a protective covering through the orifice to the extent corresponding to the length of the portion of the covering to be removed from the drinking straw. The orifice is positioned in the support to allow the protective covering to be received through the orifice but not withdrawn from the orifice. A top portion of the protective cover of a drinking straw to remain on the drinking straw is grasped, and the drinking straw is extended through the orifice to the extent of a desired amount of protective covering to be removed. The drinking straw is removed from the orifice while still grasping the top portion of the protective cover to remove the portion of the protective cover extended through the orifice.

According to another embodiment of the invention, the method includes the step of providing a guide for guiding the drinking straw into the orifice.

According to another embodiment of the invention, the method includes the step of providing a guide in the support for guiding the drinking straw into the orifice.

According to another embodiment of the invention, the method includes the step of providing a plurality of flexible blades defining the perimeter of the orifice and positioned to allow the protective covering to be received through the orifice but not withdrawn from the orifice.

According to another embodiment of the invention, the method includes the step of providing a container mounted under the support for receiving the portions of the protective covering removed from the drinking straw.

BRIEF DESCRIPTION OF THE DRAWINGS

The present invention is best understood when the following detailed description of the invention is read with reference to the accompanying drawings, in which.

DETAILED DESCRIPTION OF THE PREFERRED EMBODIMENT

Figure 1:
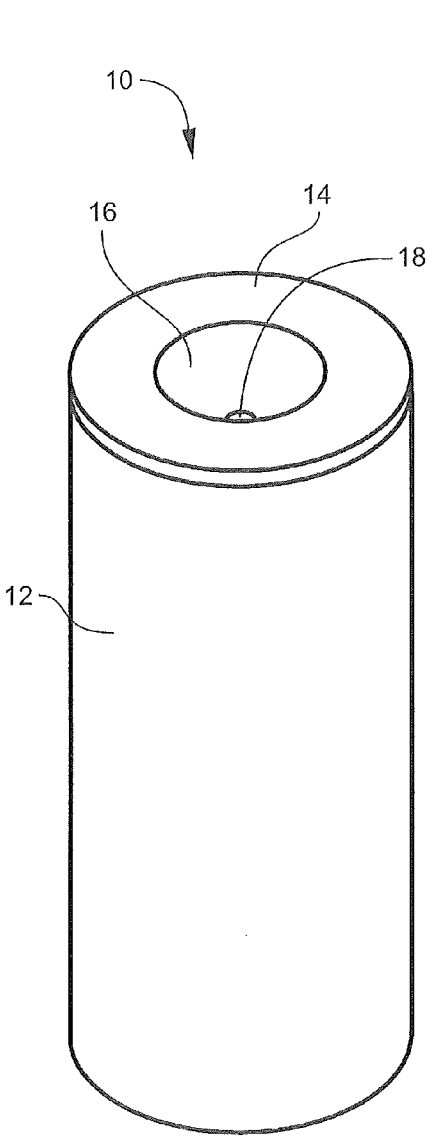
FIG. 1 is a perspective view of one preferred embodiment of the apparatus for stripping a protective covering from a drinking straw.
Figure 2:
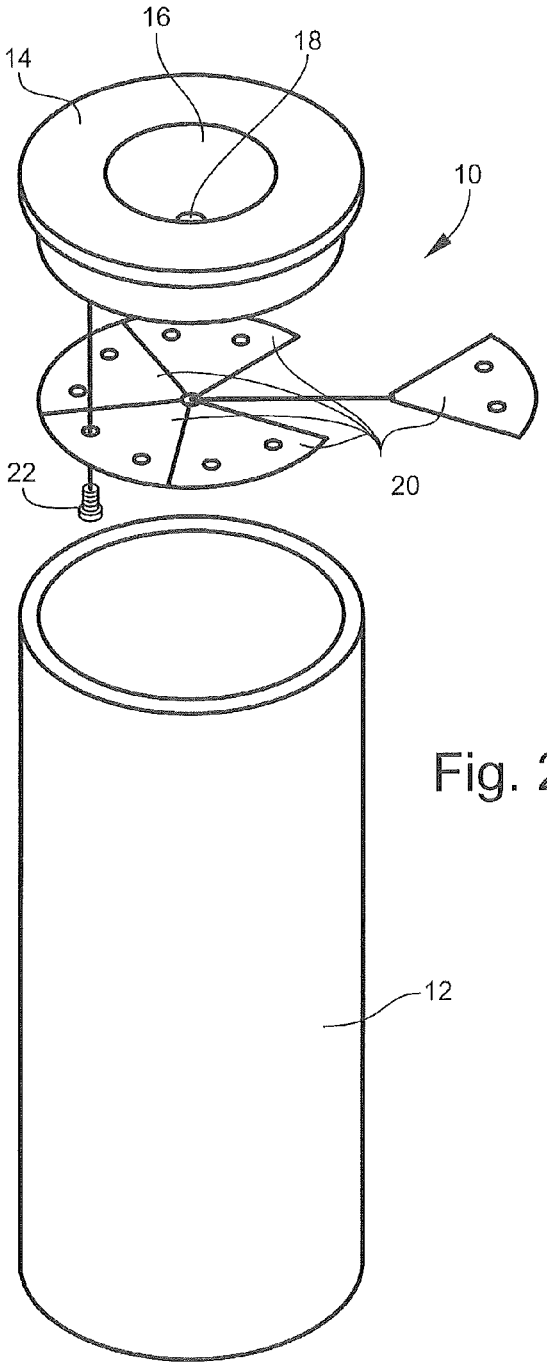
FIG. 2 is an exploded perspective view of the apparatus shown in FIG. 1.
Figure 3A:
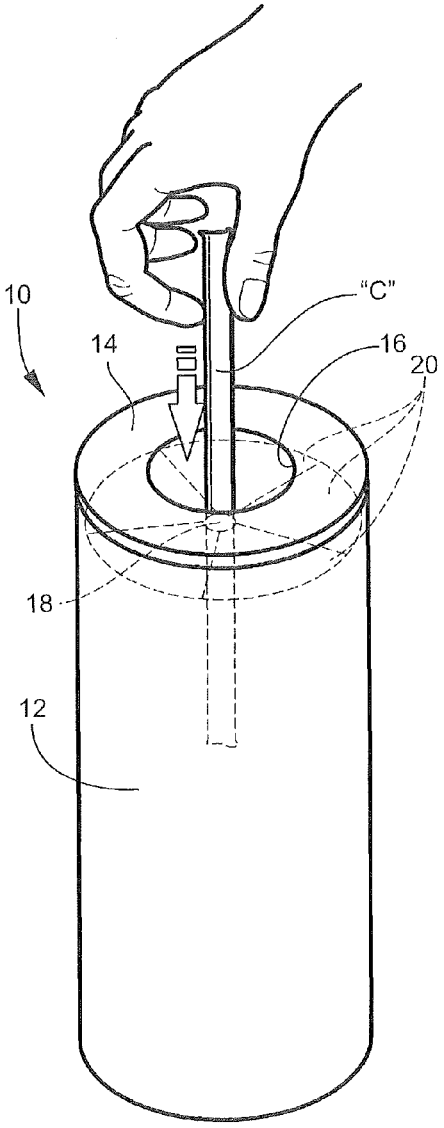
FIGS. 3A, 3B, 3C and 3D are perspective views showing the apparatus in use.
Figure 3B:
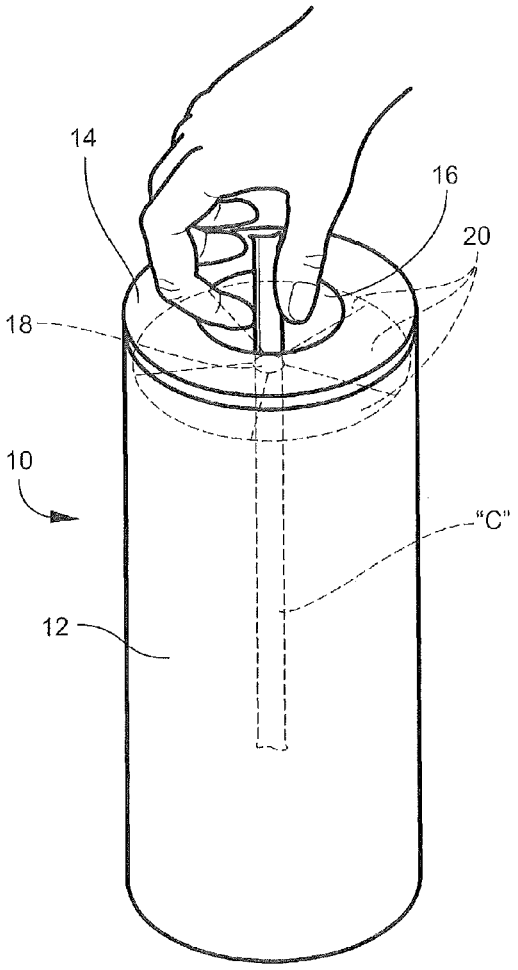
Figure 3C:
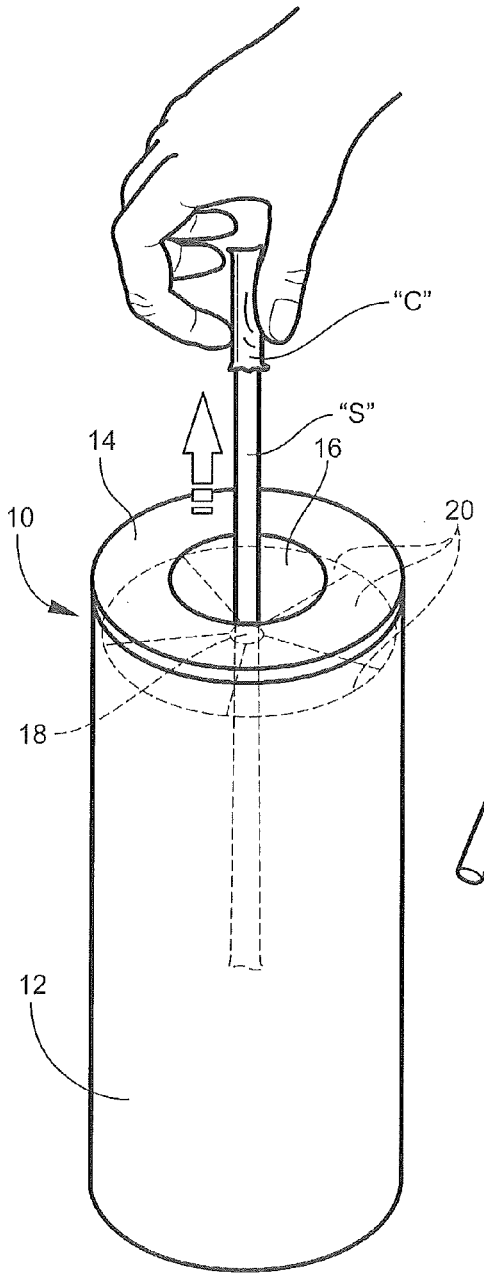
Figure 3D:
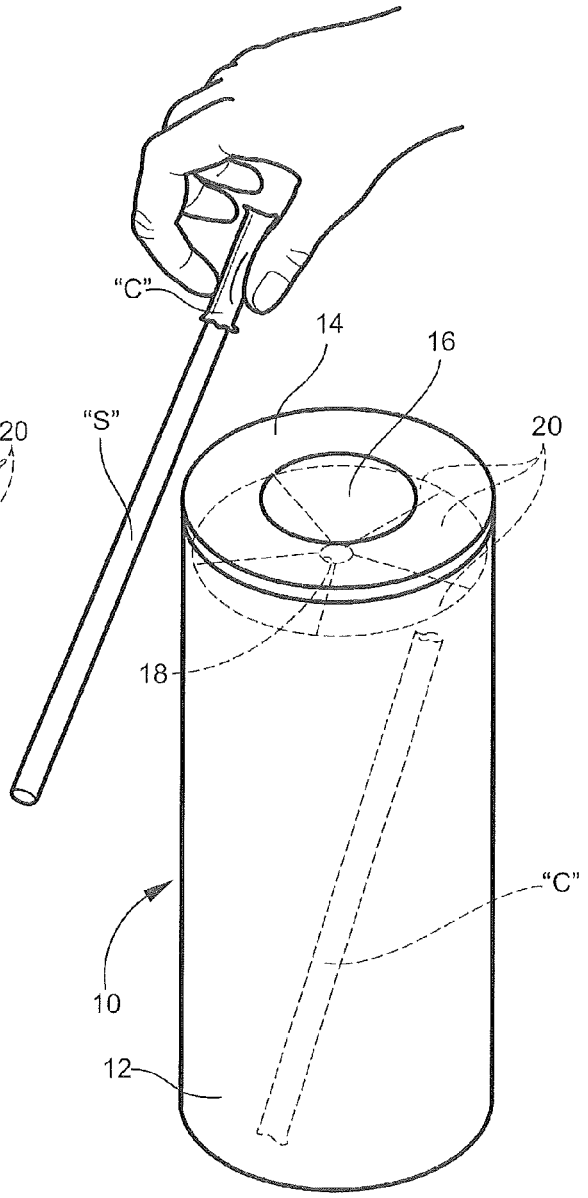

Referring now specifically to the drawings, an apparatus for stripping a protective covering "C" from a drinking straw "S" is shown at reference numeral 10 in FIGS. 1-4. As is best shown in FIGS. 1 and 2, the apparatus 10 includes a container 12, for example, a cylindrical tube having a top end to which is attached a support 14. The container 12 may be any suitable material, such as aluminum or other metal, plastic or a stiff paper or cardboard. It may or may not have an enclosed bottom. If open on the bottom, the container 12 may be provided with non-skid elements on the bottom edge, not shown, and may preferably be positioned over an opening in a refuse container or counter top refuse disposal hole. The support 14 may also be positioned directly to any suitable surface, such as a counter top or prep table such as may be found in restaurants and other food service facilities. In addition, the container according to one preferred embodiment may have a depth determined so that the straw "S" "bottoms out" at the point where the straw "S" is to be withdrawn. This facilitates providing a top cap to the straw "S" that is of uniform size. The support 14 may be secured in any suitable manner to the container 12, such as by complementary threads on the periphery of the support 14 and the top edge of the container 12.

The support 14 has a tapered opening 16 that extends downwardly and terminates at an orifice 18 that communicates with the interior of the container 12. The tapered opening 16 has a diameter at the surface of the support 14 that is several multiples of the diameter of the orifice 18 and has a depth sufficient to guide the straw "S" into the orifice 18. The term "diameter" is used in a broad sense to mean not only a geometric diameter, but also any suitable width/length dimension. The orifice 18 may be circular since almost all drinking straws "S" are circular in cross-section, or may be formed by three or more planar sides, such as a triangular, square or pentagonal opening through which the straw "S" and its covering "C" may pass. The tapered opening 16 is also preferably circular, but may be any desired shape so long as it functions to guide the straw into the orifice 18.

The orifice 18 includes a plurality of flexible blades 20 that define the shape and size of the perimeter of the orifice 18, and extend inwardly from the nominal size of the orifice 18. See FIGS. 4A, 4B and 4C. As is best shown in FIG. 2, the blades 20 are affixed, as by bolts or screws 22, to the underside of the support 14. The edges of the blades 20 are thin and have a degree of flexibility sufficient to flex downward slightly to allow the straw "S" with its protective covering "C" to pass through the orifice 18. The blades 20 are preferably stainless steel, but may be any other suitable material, such as other metals or a durable plastic or resin material.

Figure 4A:
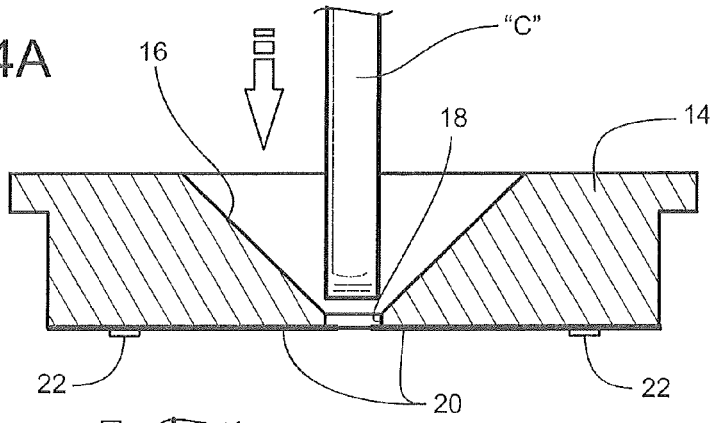
FIG. 4A is a cross-sectional view of the support showing insertion of a covered drinking straw.
Figure 4A:
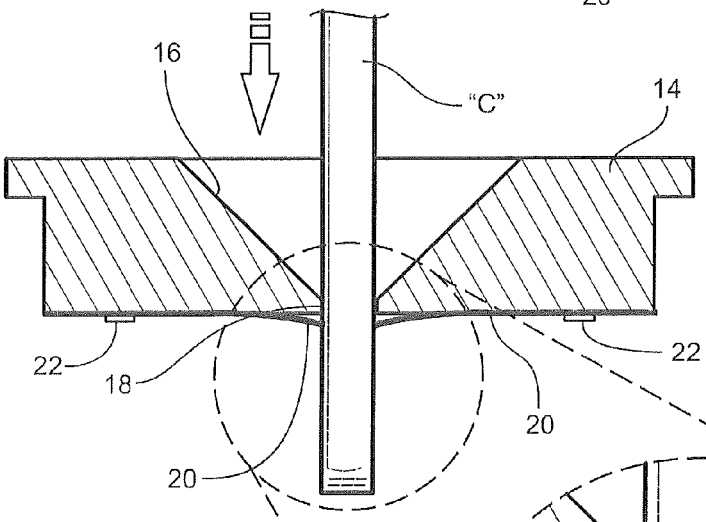
Figure 4B:
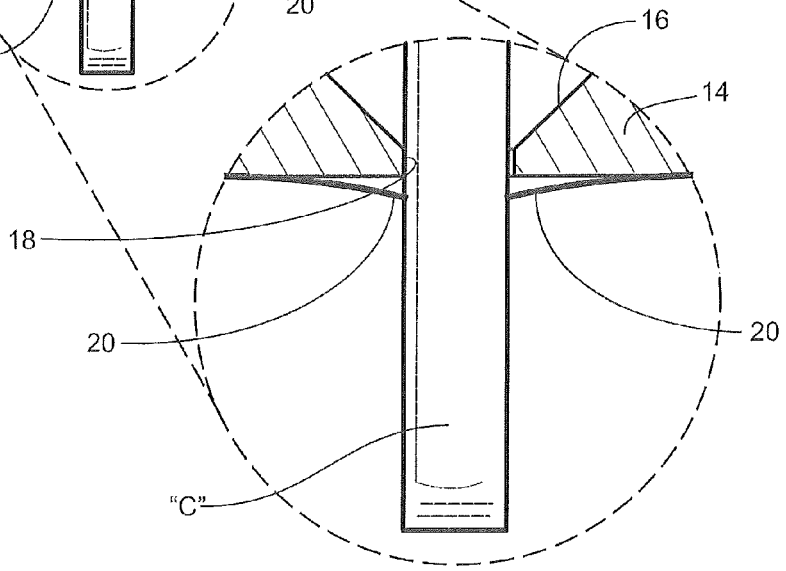
FIG. 4B is a cross-sectional view showing insertion of the drinking straw past the blades of the orifice.
Figure 4C:
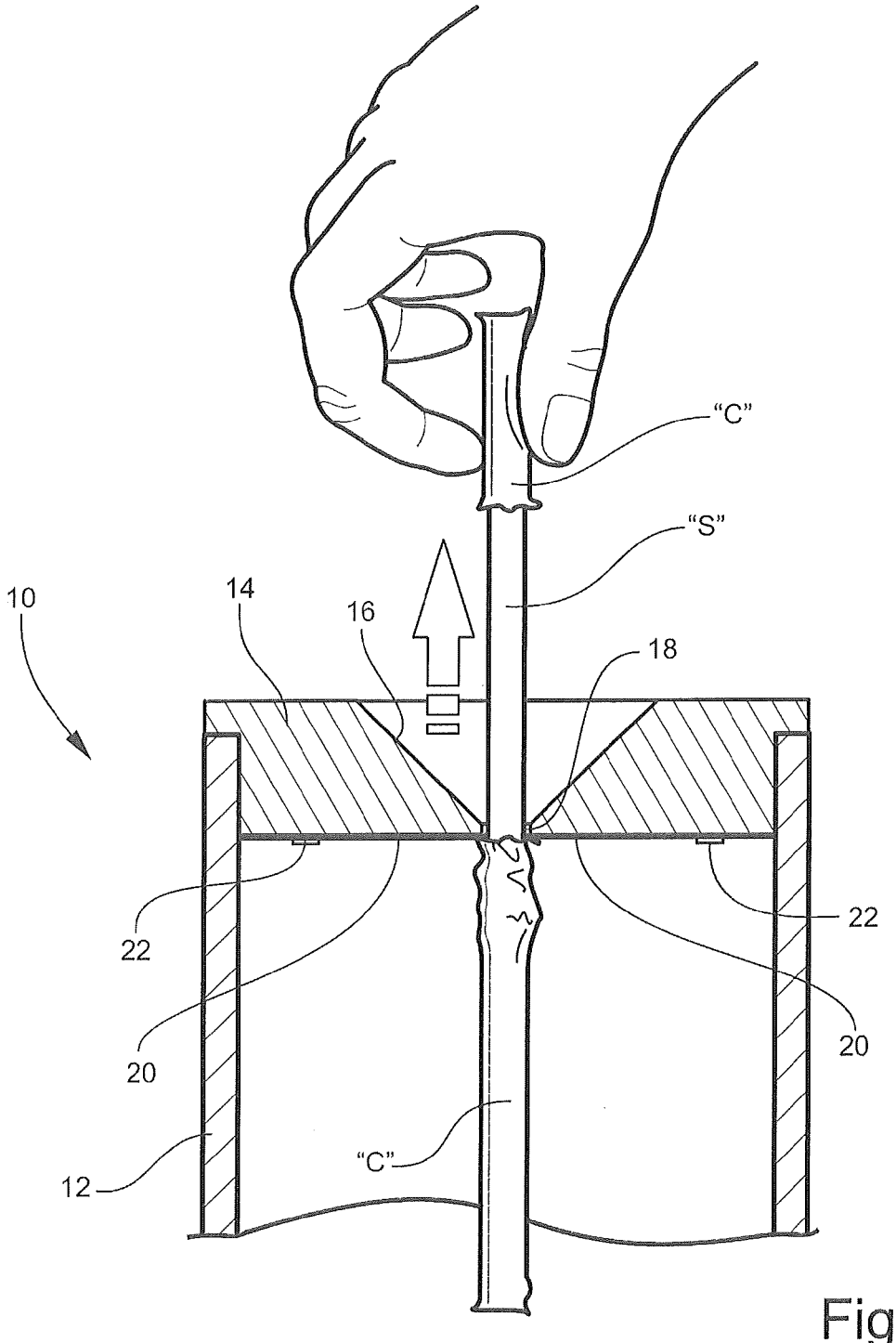
FIG. 4C is a cross-sectional view showing removal of the drinking straw with the bottom portion of the cover removed.

The size of the orifice 18 is determined empirically to allow the blades 20 to function in the required manner. For example, one typical drinking straw "S" diameter is 0.250 inch. The paper or plastic film covering "C" in which the straw "S" is packaged is sufficiently thin to be irrelevant in determining the correct orifice 18 size. Whether or not the orifice 18 shape is circular or some other shape, the blades 20 should be positioned so that the straw "S" passes with moderate force through the orifice 18 with the covering "C" being scraped by the blades 20 as the blades 20 flex slightly. See FIGS. 3B and 4B. When the straw "S" has been extended to its desired depth in the container 12, it is then withdrawn back through the orifice 18. See FIGS. 3C and 4C. The blades 20 are sufficiently thin to grip the covering "C" as the straw "S" is withdrawn from the orifice 18, tearing the covering "C" and allowing the straw "S" and the top portion of the covering "C" being grasped by the user to be removed, leaving the bottom portion of the covering "C" behind in the container 12. See FIGS. 3A, 3B, 3C and 3D. Note that the orifice 18 in support 14 prevents the blades 20 from flexing upwardly, as best shown in FIG. 4B.

EXAMPLE

Dimensions for one preferred embodiment are set out below, and suitable for use with drinking straws "S" packaged in a paper protective covering "C", and having a nominal diameter of 0.250 inch:

| Element | Dimension |
|---|---|
| Diameter of container 12 | 4.5 inches |
| Diameter of support 14 | 4.5 inches |
| Diameter of tapered opening 16 at surface of support 14 | 2.250 inches |
| Diameter of tapered opening 16 at level of orifice 18 | .375 inches |
| Angle of tapered opening 16 | 90 degrees |
| Depth of tapered opening 16 | 1 inch |
| Diameter of orifice 18 opening in support 14 | .375 inch |
| Diameter of orifice 18 defined by blades 20 | .250 inch (also diameter of straw) |
| Thickness of blades 20 at straw contact edge | .008 inch |

A method and apparatus for removing a portion of a protective covering from a drinking straw according to a preferred embodiment of the invention have been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. An apparatus for removing a portion of a protective covering from a drinking straw, comprising:

(a) a support mounted on a container for receiving the portion of the protective covering removed from the drinking straw;

(b) a fixed orifice in the support having a shape and a fixed diameter adapted for receiving the drinking straw packaged in the protective covering through the fixed orifice to the extent corresponding to the length of the portion of the covering to be removed from the drinking straw, the orifice positioned in the support to allow the protective covering to be received through the orifice but not withdrawn from the orifice; and (c) a plurality of flexible blades positioned below the fixed orifice of the support and having a wedge shape and an arcuate cutting edge collectively defining a perimeter of a flexible orifice having a first diameter that is the same or smaller than the diameter of the fixed orifice, and wherein the flexible blades flex downward, and only downward, as the straw is inserted to form a second larger diameter than the first diameter, and flex upward, and only upward, towards a stop as the straw is retracted to return to the first diameter and thereby cut and remove the portion of the protective covering from the straw by engagement of the cutting edges of the flexible blades through the protective cover and against the straw;

wherein as the straw is retracted a to side of the plurality of flexible blades is in contact with a bottom side of the fixed orifice, the bottom side of the fixed orifice forming the stop.

2. An apparatus according to claim 1, and including a container mounted under the support for receiving the portions of the protective covering removed from the drinking straw.

3. An apparatus according to claim 1, and including a rigid, non-flexible tapered opening in the support for guiding the straw into the support.

4. An apparatus for removing a portion of a protective covering from a drinking straw, comprising:

(a) a support mounted on a container for receiving the portion of the protective covering removed from the drinking straw;

(b) a rigid, non-flexible tapered opening in the support for guiding the straw into the support;

(c) a fixed orifice defining the bottom of the support and having a shape and a diameter adapted for receiving a drinking straw packaged in a protective covering through the orifice to the extent corresponding to the length of the portion of the covering to be removed from the drinking straw; and (d) a plurality of flexible blades having a wedge shape and an arcuate cutting edge, the arcuate edges of the flexible blades collectively defining the perimeter of a flexible orifice positioned to allow the protective covering to be received through the flexible orifice but not withdrawn from the flexible orifice;

wherein the flexible blades flex downward, and only downward, as the straw is inserted, and flex upward, and only upward, towards a stop as the straw is retracted to thereby cut and remove the portion of the protective covering from the straw by engagement of the arcuate cutting edge of the flexible blades through the protective cover and against the straw;

wherein as the straw is retracted, a top side of the plurality of flexible blades is in contact with a bottom side of the fixed orifice, the bottom side of the fixed orifice forming the stop.

* * * * *

UNITED STATES PATENT AND TRADEMARK OFFICE

CERTIFICATE OF CORRECTION

PATENT NO. : 8,814,021 B2
APPLICATION NO. : 13/346788
DATED : August 26, 2014
INVENTOR(S) : Aaron W. Jones It is certified that error appears in the above-identified patent and that said Letters Patent is hereby corrected as shown below:

In the Claims

Column 5, line 1 “retracted a to” should read “retracted, a top”

Signed and Sealed this
Twenty-third Day of December, 2014

Michelle K. Lee

Michelle K. Lee
*Deputy Director of the United States Patent and Trademark Office*